US011208277B2

(12) United States Patent
Tanaka et al.

(10) Patent No.: US 11,208,277 B2
(45) Date of Patent: Dec. 28, 2021

(54) IMAGE FORMING APPARATUS

(71) Applicant: KYOCERA Document Solutions Inc., Osaka (JP)

(72) Inventors: Hiroyuki Tanaka, Osaka (JP); Takashi Namii, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 418 days.

(21) Appl. No.: 16/305,727

(22) PCT Filed: Jun. 5, 2018

(86) PCT No.: PCT/JP2018/021584
§ 371 (c)(1),
(2) Date: Nov. 29, 2018

(87) PCT Pub. No.: WO2019/053966
PCT Pub. Date: Mar. 21, 2019

(65) Prior Publication Data

US 2021/0221632 A1 Jul. 22, 2021

(30) Foreign Application Priority Data

Sep. 14, 2017 (JP) ..... JP2017-176517

(51) Int. Cl.
*B65H 1/26* (2006.01)
*B65H 1/04* (2006.01)

(52) U.S. Cl.
CPC ..... *B65H 1/266* (2013.01); *B65H 1/04* (2013.01); *B65H 2801/06* (2013.01)

(58) Field of Classification Search
CPC ..... B65H 1/266; B65H 2407/21; B65H 2801/06; G03G 2215/00392
(Continued)

(56) References Cited

U.S. PATENT DOCUMENTS 5,002,266 A * 3/1991 Kikuchi ..... B41J 13/00 271/109
7,036,813 B2 * 5/2006 Asada ..... B65H 3/0669 271/117

(Continued)

FOREIGN PATENT DOCUMENTS

JP 2008-239328 A 10/2006
JP 2009-269753 A 11/2009

OTHER PUBLICATIONS

Extended European Search Report dated May 11, 2021, issued by the European Patent Office in corresponding application EP 18819520.0.

(Continued)

*Primary Examiner* — Michael McCullough
(74) *Attorney, Agent, or Firm* — Stein IP, LLC

(57) ABSTRACT

An image forming apparatus can prevent an apparatus main body from moving when a recording medium storing cassette is extracted from the apparatus main body. The image forming apparatus has an apparatus main body, a recording medium storing cassette, and a manual feed tray arranged swingably over the recording medium storing cassette. The recording medium storing cassette has a first side face a handle part provided in the first side face. The manual feed tray has a second side face arranged continuous with the first side face. In a part over the handle part, between the first side face and the second side face, a supporting portion in the apparatus main body is arranged.

9 Claims, 3 Drawing Sheets

(58) Field of Classification Search
USPC ..... 271/9.09; 399/392; D18/46, 50, 53, 56
See application file for complete search history.

(56) References Cited

U.S. PATENT DOCUMENTS

| | | | | |
|---|---|---|---|---|
| 7,444,113 | B2 * | 10/2008 | Kobayashi | G03G 15/6502 399/369 |
| 7,639,965 | B2 * | 12/2009 | Palumbo | G03G 15/6529 399/107 |
| 7,731,170 | B2 * | 6/2010 | Nishii | G03G 21/1647 271/9.09 |
| 8,857,808 | B2 * | 10/2014 | Matsumoto | B65H 1/04 271/9.09 |
| 9,604,806 | B2 * | 3/2017 | Okura | G03G 15/6514 |
| 10,053,311 | B2 * | 8/2018 | Bui | G03G 15/6514 |
| 10,241,464 | B2 * | 3/2019 | Ao | B65H 1/04 |
| 10,477,047 | B2 * | 11/2019 | Uchida | H04N 1/0053 |
| 2002/0164190 | A1 | 11/2002 | Hill | 400/624 |
| 2005/0151315 | A1 | 7/2005 | Yokoi | 271/145 |
| 2007/0164500 | A1 * | 7/2007 | Lim | B65H 3/66 271/9.09 |
| 2008/0237972 | A1 | 10/2008 | Ohnishi | 271/164 |
| 2010/0172678 | A1 * | 7/2010 | Kim | B65H 1/266 399/393 |
| 2015/0183597 | A1 | 7/2015 | Kobayashi | |
| 2019/0071268 | A1 * | 3/2019 | Nishioka | B65H 1/266 |
| 2020/0165085 | A1 * | 5/2020 | Toyama | B65H 3/0607 |
| 2020/0331715 | A1 * | 10/2020 | Yokoyama | B65H 1/266 |

OTHER PUBLICATIONS

Chinese Office Action dated Jun. 23, 2021, issued by the China National Intellectual Property Administration in corresponding application CN 201880002150.2.

* cited by examiner

IMAGE FORMING APPARATUS

CROSS-REFERENCE TO RELATED APPLICATIONS

This application is a national stage of International Application No. PCT/JP2018/021584, filed Jun. 5, 2018, which claims the benefit of priority to Japanese Application No. 2017-176517, filed Sep. 14, 2017, in the Japanese Patent Office, the disclosures of which are incorporated herein by reference.

TECHNICAL FIELD

The present invention relates to an image forming apparatus. More particularly, the present invention relates to an image forming apparatus provided with a recording medium storing cassette which is extractable and insertable with respect to one side face of an apparatus main body.

BACKGROUND ART

Conventionally, there is known an image forming apparatus provided with a sheet feed cassette (recording medium storing cassette) which is extractable and insertable with respect to one side face of an apparatus main body. As such an image forming apparatus, there is known an image forming apparatus that is provided with a lock mechanism locking the sheet feed cassette on the apparatus main body so that releasing the lock makes the sheet feed cassette extractable (for example, see Patent Document 1). In this image forming apparatus, when a user extracts the sheet feed cassette from the apparatus main body, it is necessary first to release the lock. It is also necessary to provide a mechanism which switches from a locked state to an unlocked state in a front face part of the sheet feed cassette, and this leads to a complicated structure and an increased size.

To avoid that, there is known an image forming apparatus in which a concave (or convex) first engagement portion is provided in a side face of the sheet feed cassette, a convex (or concave) second engagement part is provided on the apparatus main body, and the second engagement portion is biased by a spring member to engage with the first engagement portion.

LIST OF CITATIONS

Patent Literature

Patent Document 1: JP-A-2008-239328

SUMMARY OF THE INVENTION

Technical Problem

In the conventional image forming apparatus in which the second engagement portion is biased by the above-described spring member to engage with the first engagement portion, when the biasing force of the spring member is weak, the sheet feed cassette can be extracted with a weak force, and is thus easy to operate. However, the sheet feed cassette can move with respect to the apparatus main body (move out of the apparatus main body) due to vibration during sheet feeding, a rotation force of a sheet feed roller, and the like, and to prevent that, the biasing force of the spring member needs to be increased in some degree.

However, in a case where the biasing force of the spring member is increased in some degree, when a user holds only the sheet feed cassette to extract it, the first engagement portion and the second engagement portion may not disengage from each other. This inconveniently results in the apparatus main body moving together with the sheet feed cassette in the extracting direction with respect to the placement portion (such as a desk) on which the apparatus main body is placed. Such a phenomenon is likely to occur in an image forming apparatus which is compact and lightweight (with a mass of 20 kg or less). The bottom face of the apparatus main body is provided with two front leg parts and two rear leg parts that support the apparatus main body. In a case where at least one of the two front leg parts and the two rear leg parts is made not of elastic member such as rubber but of sheet metal or resin, the phenomenon mentioned above is particularly likely to occur compared with a structure where the whole leg parts are made of elastic member such as rubber.

The present invention has been made to solve the above-described problem and an object of the present invention is to provide an image forming apparatus that can prevent the apparatus main body from moving when a recording medium storing cassette is extracted from the apparatus main body.

Means for Solving the Problem

An image forming apparatus according to a first aspect of the present invention includes an apparatus main body, a recording medium storing cassette which is provided to be extractable and insertable with respect to one side face of the apparatus main body, and a manual feed tray which is swingably arranged over the recording medium storing cassette and which is arranged selectively either in a first position where the manual feed tray is housed in the one side face or in a second position where the manual feed tray is open at a predetermined angle with respect to the one side face. The recording medium storing cassette has a first side face which, when the recording medium storing cassette is inserted in the apparatus main body, constitutes part of the exterior surface of the image forming apparatus, and has a handle part which is provided in the first side face and into which fingers can be inserted from below upward. The manual feed tray has a second side face which, when the manual feed tray is arranged in the first position, constitutes part of the exterior surface and is arranged continuous with the first side face. In a part over the handle part, between the first side face and the second side face, a supporting portion which is provided in the apparatus main body and which has a supporting face constituting part of the exterior surface is arranged.

Advantageous Effects of the Invention

In the image forming apparatus according to the first aspect of the present invention, in a part over the handle part of the recording medium storing cassette, between the first side face of the recording medium storing cassette and the second side face of the manual feed tray, the supporting portion which is provided in the apparatus main body is arranged. Thus, when the recording medium storing cassette is extracted with one hand, it is possible to extract the recording medium storing cassette with the thumb put on the supporting portion of the apparatus main body; thus, it is possible to prevent the apparatus main body from moving together with the recording medium storing cassette.

In a structure in which the second side face of the manual feed tray is arranged continuous with the first side face of the recording medium storing cassette and in which no supporting portion is provided, if a swing shaft of the manual feed tray is arranged above a position at which the thumb is put, when the thumb is put on the manual feed tray, the manual feed tray opens. When the manual feed tray is in the open state, the manual feed tray is inclined; thus, it is impossible to put the thumb on the manual feed tray. However, as in this invention, by providing the supporting portion in a part over the handle part of the recording medium storing cassette, between the first side face of the recording medium storing cassette and the second side face of the manual feed tray, even when the swing shaft of the manual feed tray is arranged above the position at which the thumb is put, it is possible to prevent the manual feed tray from opening when the recording medium storing cassette is extracted. Moreover, even when the manual feed tray is in the open state, it is possible to extract the recording medium storing cassette with the thumb put on the supporting portion. Accordingly, it is particularly effective to apply the present invention to the structure in which the second side face of the manual feed tray is arranged continuous with the first side face of the recording medium storing cassette.

Further features and advantages of the present disclosure will become apparent from the description of embodiments given below.

DESCRIPTION OF EMBODIMENTS

Hereinafter, with reference to the accompanying drawings, an embodiment of the present disclosure will be described.

Figure 1:
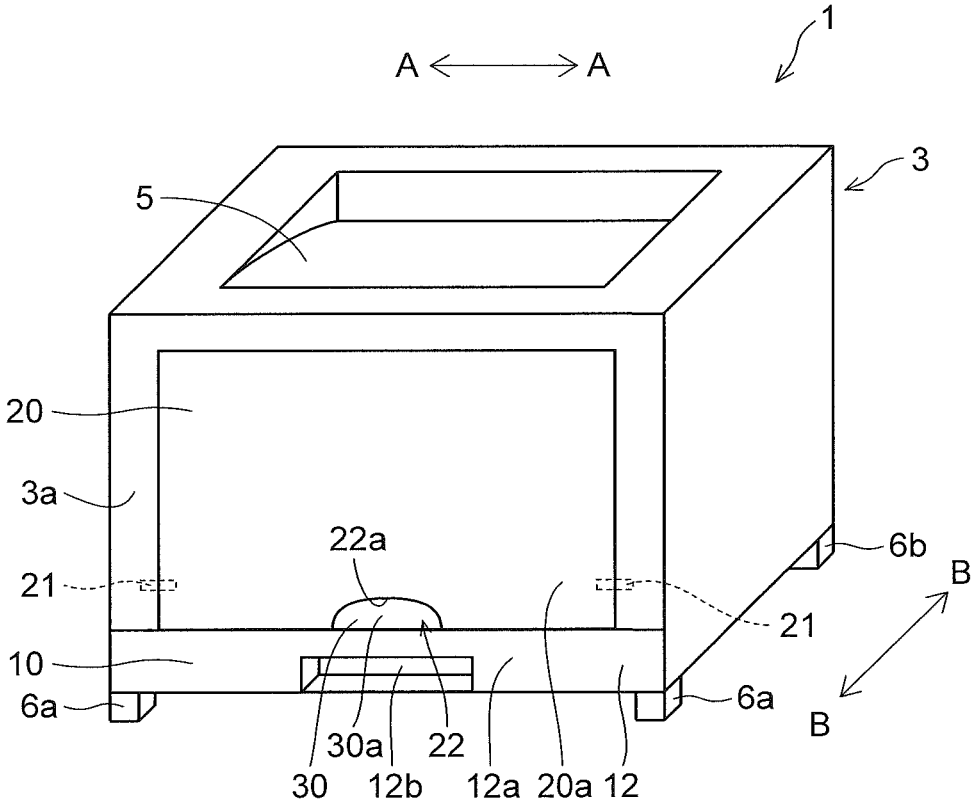
FIG. 1 is a perspective view showing a structure of an image forming apparatus according to one embodiment of the present invention.

With reference to FIGS. 1 to 6, an image forming apparatus 1 according to one embodiment of the present disclosure will be described. As shown in FIG. 1, the image forming apparatus 1 (here, a printer) includes an apparatus main body 3 having a substantially hexahedron structure. The front face (one side face) 3*a* of the apparatus main body 3 that a user faces is provided with a sheet feed cassette (recording medium storing cassette) 10 which is mountable and dismountable in the front-rear direction with respect to the apparatus main body 3, and a manual feed tray 20 which is swingably arranged over the sheet feed cassette 10 and which is openable and closable with respect to the apparatus main body 3. An upper part of the apparatus main body 3 is provided with a discharge tray 5 onto which a sheet is discharged from the rear face side of the apparatus toward the front face side of the apparatus. The image forming apparatus 1 according to this embodiment is compact and lightweight (with a mass of 20 kg or less).

In the apparatus main body 3, an image forming portion, a fixing portion, a sheet conveying passage, and the like, of which none is illustrated, are provided. Based on image data received from a terminal such as a personal computer, the image forming portion transfers a toner image to a sheet which is fed to it and forms an image. The image forming portion includes a photosensitive drum (image carrying member) which carries an electrostatic latent image, a charging unit which electrostatically charges the surface of the photosensitive drum, an exposure unit which forms an electrostatic image corresponding to a document image on the surface of the photosensitive drum with a laser beam or the like, a developing device which forms a toner image by attaching developer to the formed electrostatic latent image, a transfer roller which transfers the toner image to a sheet, a cleaning blade which removes the unused toner on the surface of the photosensitive drum, and the like. The fixing portion heats and presses the sheet having the toner image transferred to it, and thereby fixes the toner image to the sheet.

The bottom face of the apparatus main body 3 is provided with two front leg parts 6*a* and two rear leg parts 6*b* that support the apparatus main body 3. The front leg part 6*a* is made of rubber, so that it resists slipping on the placement face. On the other hand, the rear leg part 6*b* is made of sheet metal or resin.

Figure 2:
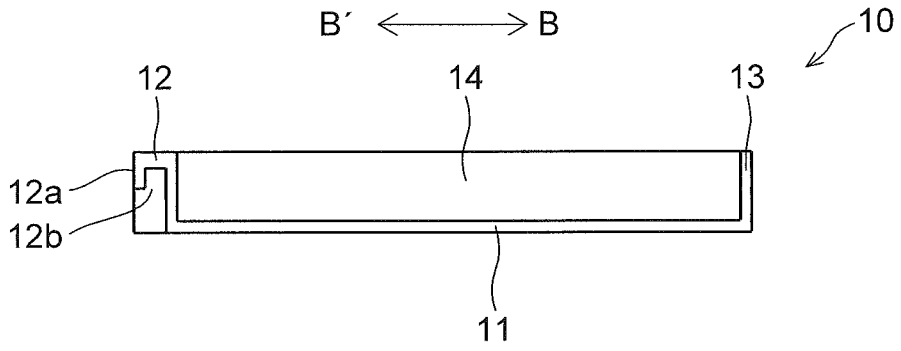
FIG. 2 is a sectional view showing a structure of a sheet feed cassette in the image forming apparatus according to the one embodiment of the present invention.

As shown in FIG. 2, the sheet feed cassette 10 is formed in the shape of a flat box open at the top face, so that sheets can be stored in it by being stacked from the top face direction. The sheet feed cassette 10 includes a bottom face part 11 on which sheets are stacked as well as a front face part 12, a rear face part 13, and a pair of side face parts 14 that are formed upright in a peripheral part of the bottom face part 11 along its four sides.

In the image forming apparatus 1, a sheet feeding device (unillustrated) is arranged over the front face part 12 located on the upstream side of the sheet feed cassette 10 in its inserting direction. A sheet in the sheet feed cassette 10 is first conveyed in the direction indicated by arrow B' shown in FIG. 2 (to the upstream side of the sheet feed cassette 10 in its inserting direction), and is then conveyed in the direction indicated by arrow B. The front face part 12 is arranged on the side to which the direction indicated by arrow B' points.

The front face part 12 has a front face (a first side face) 12*a* which constitutes part of the exterior surface of the image forming apparatus 1 by being exposed to outside with the sheet feed cassette 10 inserted in the apparatus main body 3, and a handle part 12*b* which is formed in the front face 12*a* and into which fingers can be inserted from below upward. The handle part 12*b* is arranged in a middle part of the front face 12*a* in the sheet width direction (the direction indicated by arrows A and A', that is, the direction perpendicular to the sheet conveying direction).

Figure 3:
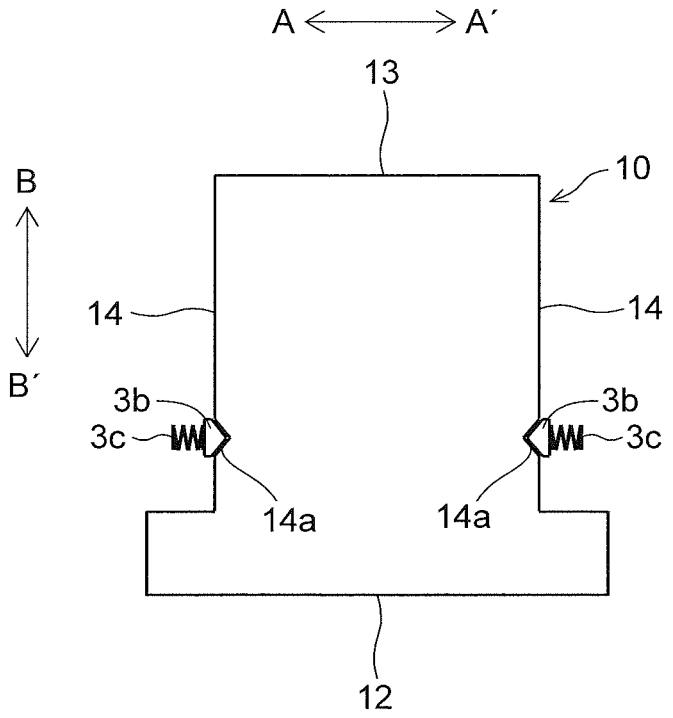
FIG. 3 is a schematic view illustrating a structure of and around an engagement concave part of the sheet feed cassette in the image forming apparatus according to the one embodiment of the present invention.

As shown in FIG. 3, the pair of side face parts 14 of the sheet feed cassette 10 is provided with engagement concave parts 14*a* which engage with the apparatus main body 3. The apparatus main body 3 is provided with engagement convex parts 3*b* which engage with the engagement concave parts

14*a* and biasing members 3*c* which comprise compression springs biasing the engagement convex parts 3*b* toward the inside of the apparatus main body 3 with a predetermined biasing force. Thus, when the sheet feed cassette 10 is inserted into the apparatus main body 3 up to a predetermined position, the engagement convex parts 3*b* engage with the engagement concave parts 14*a*, so that the sheet feed cassette 10 is locked on the apparatus main body 3. On the other hand, when the sheet feed cassette 10 is pulled to the downstream side of the apparatus main body 3 in the extracting direction, the engagement convex parts 3*b* move toward the outside of the apparatus main body 3 against the biasing force of the biasing members 3*c*; thus, the engagement convex parts 3*b* and the engagement concave parts 14*a* disengage from each other, so that the sheet feed cassette 10 is extracted from the apparatus main body 3.

As shown in FIG. 1, the manual feed tray 20 swings about a swing shaft 21 arranged at either side of a lower part of the manual feed tray 20 in the sheet width direction, and is thus openable and closable with respect to the apparatus main body 3. The manual feed tray 20 is arranged selectively either in a first position (the position in FIG. 1) where it is housed in the front face 3*a* of the apparatus main body 3 or in a second position (the position in FIG. 4) where it is open at a predetermined angle with respect to the front face 3*a*. The manual feed tray 20 has a front face (a second side face) 20*a* which, when the manual feed tray 20 is arranged in the first position, constitutes part of the exterior surface of the image forming apparatus 1 and is arranged continuous with the front face 12*a* of the sheet feed cassette 10.

Here, in this embodiment, a supporting portion 30 provided in the apparatus main body 3 is arranged in a part over the handle part 12*b*, between the front face 12*a* of the sheet feed cassette 10 and the front face 20*a* of the manual feed tray 20. The supporting portion 30 has a supporting face 30*a* which constitutes part of the exterior surface of the image forming apparatus 1. The supporting portion 30 is provided to allow a thumb to be put on it when the sheet feed cassette 10 is extracted from the apparatus main body 3 with one hand.

Figure 4:
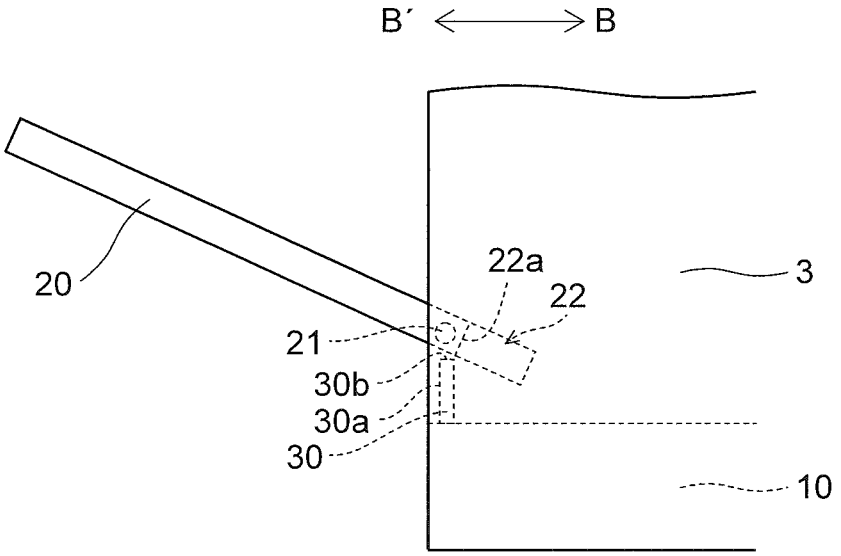
FIG. 4 is a side view showing a structure of and around a manual feed tray in the image forming apparatus according to the one embodiment of the present invention, showing a state where the manual feed tray is open.

In a lower end part of the front face 20*a* of the manual feed tray 20, a cutout portion 22 surrounding part of the outer circumferential edge of the supporting portion 30 is formed. As shown in FIG. 4, the top end 22*a* of the cutout portion 22 is arranged, when the manual feed tray 20 is in the open state (the state where it is arranged in the second position), above the center of the supporting face 30*a* of the supporting portion 30 in the up-down direction. In this embodiment, the swing shaft 21 of the manual feed tray 20 is arranged above the top end 30*b* of the supporting portion 30. Thus, the top end 22*a* of the cutout portion 22 is arranged, when the manual feed tray 20 is in the open state, above the top end 30*b* of the supporting portion 30.

Figure 5:
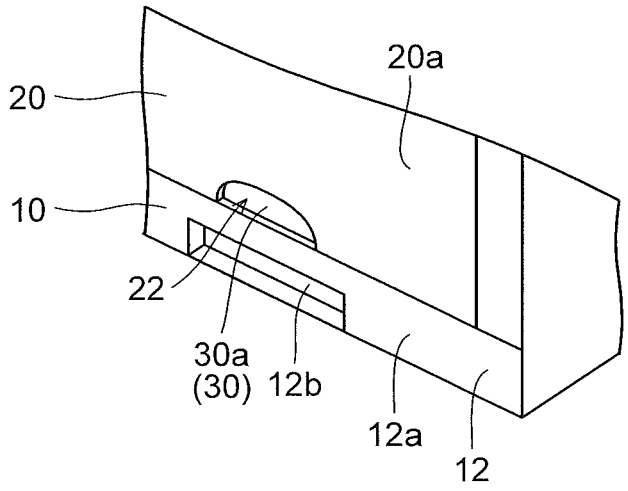
FIG. 5 is a perspective view showing a structure of and around a supporting portion in the image forming apparatus according to the one embodiment of the present invention.

The supporting face 30*a* of the supporting portion 30 is arranged substantially perpendicularly to the extracting direction of the sheet feed cassette 10. As shown in FIG. 5, at least part (here, the whole) of the supporting face 30*a* is arranged inside the apparatus main body 3 (on the downstream side in the inserting direction of the sheet feed cassette 10) with respect to the front face 12*a* of the sheet feed cassette 10 and the front face 20*a* of the manual feed tray 20. That is, a step is formed between, at one end, the supporting face 30*a* and, at the other end, the front face 12*a* of the sheet feed cassette 10 and the front face 20*a* of the manual feed tray 20.

Figure 6:
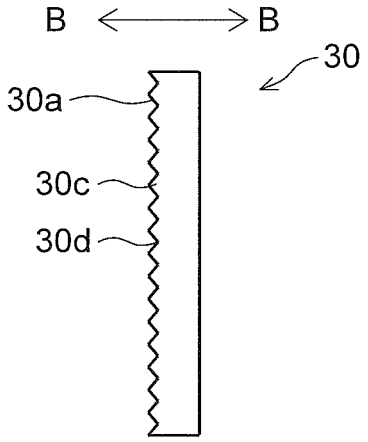
FIG. 6 is an enlarged side view showing a structure of the supporting portion in the image forming apparatus according to the one embodiment of the present invention.

As shown in FIG. 6, on the supporting face 30*a*, surface irregularities are formed which have a plurality of convex parts 30*c* and concave parts 30*d* alternately arranged along at least the up-down direction. Although in this embodiment, the convex parts 30*c* and the concave parts 30*d* are formed so as to extend in the horizontal direction, instead, the convex parts 30*c* and the concave parts 30*d* may be arranged alternately along the up-down direction and the horizontal direction. The convex parts 30*c* and the concave parts 30*d* are formed by knurling or the like.

The supporting face 30*a* is formed in a different color from the front face 20*a* of the manual feed tray 20 but in the same color as the front face 12*a* of the sheet feed cassette 10. Here, the supporting face 30*a* and the front face 12*a* of the sheet feed cassette 10 are formed in white or a light color (cream color or the like), and the front face 20*a* of the manual feed tray 20 is formed in a deep color (for example, black, dark gray, dark blue, dark green, dark red, or dark brown).

The supporting face 30*a* is formed to have a size of 20 mm or more in the up-down direction and to have a size approximately equal (for example, 100 mm) to the width of the handle part 12*b* in the horizontal direction.

In the image forming apparatus 1, when the sheet feed cassette 10 is extracted from the apparatus main body 3, a user inserts fingers into the handle part 12*b* of the sheet feed cassette 10 from below, and pulls the sheet feed cassette 10 with the thumb put on the supporting face 30*a* of the supporting portion 30. Thus, the engagement convex parts 3*b* of the apparatus main body 3 and the engagement concave parts 14*a* of the sheet feed cassette 10 disengage from each other. Accordingly, without the apparatus main body 3 being moved, the sheet feed cassette 10 is extracted from the apparatus main body 3.

In this embodiment, as described above, the supporting portion 30 provided in the apparatus main body 3 is arranged in the part over the handle part 12*b* of the sheet feed cassette 10, between the front face 12*a* of the sheet feed cassette 10 and the front face 20*a* of the manual feed tray 20. Thus, when the sheet feed cassette 10 is extracted with one hand, it is possible to extract the sheet feed cassette 10 with the thumb put on the supporting portion 30 of the apparatus main body 3; thus, it is possible to prevent the apparatus main body 3 from moving together with the sheet feed cassette 10. In the image forming apparatus 1 which is compact and lightweight (with a mass of 20 kg or less) and of which at least one of the leg parts (here, two rear leg parts 6*b*) is made of sheet metal or resin, the friction between the leg parts and the placement face (for example, the top face of a desk) is comparatively low, so that the apparatus main body 3 is prone to move; thus, it is particularly effective to apply the present invention.

In a structure in which the front face 20*a* of the manual feed tray 20 is arranged continuous with the front face 12*a* of the sheet feed cassette 10 and in which no supporting portion 30 is provided, if the swing shaft 21 of the manual feed tray 20 is arranged above a position at which the thumb is put, when the thumb is put on the manual feed tray 20, the manual feed tray 20 opens. When the manual feed tray 20 is in the open state, the manual feed tray 20 is inclined; thus, it is impossible to put the thumb on the manual feed tray 20. However, as in this embodiment, by providing the supporting portion 30 in the part over the handle part 12*b* of the sheet feed cassette 10, between the front face 12*a* of the sheet feed cassette 10 and the front face 20*a* of the manual feed tray 20, even when the swing shaft 21 of the manual feed tray 20 is arranged above the position at which the thumb is put, it is possible to prevent the manual feed tray 20 from opening when the sheet feed cassette 10 is extracted. Moreover, even when the manual feed tray 20 is in the open state, it is possible to extract the sheet feed cassette 10 with the thumb put on the supporting portion 30. Accordingly, it is particularly effective to apply the present invention to the structure in which the front face 20*a* of the manual feed tray 20 is arranged continuous with the front face 12*a* of the sheet feed cassette 10.

As described above, in the structure in which the front face 20*a* of the manual feed tray 20 is arranged continuous with the front face 12*a* of the sheet feed cassette 10 and in which no supporting portion 30 is provided, if the swing shaft 21 of the manual feed tray 20 is arranged above the position at which the thumb is put, when the thumb is put on the manual feed tray 20, the manual feed tray 20 is opened. Thus, it is particularly effective to apply the present invention to a case where the swing shaft 21 of the manual feed tray 20 is arranged above the top end 30*b* of the supporting portion 30 (the position at which the thumb is put).

As described above, the supporting face 30*a* is arranged substantially perpendicularly to the extracting direction of the sheet feed cassette 10. Accordingly, when the thumb is put on the supporting portion 30, it is possible to achieve stability; thus, it is possible to stably extract the sheet feed cassette 10.

As described above, at least part (here, the whole) of the supporting face 30*a* is arranged inside the apparatus main body 3 with respect to the front face 12*a* of the sheet feed cassette 10 and the front face 20*a* of the manual feed tray 20. Accordingly, it is possible to prevent the thumb from coming off the supporting portion 30 when the sheet feed cassette 10 is extracted. It is also possible to improve the visibility of the supporting face 30*a*.

As described above, on the supporting face 30*a*, surface irregularities are formed which have a plurality of convex parts 30*c* and concave parts 30*d* alternately arranged along at least the up-down direction. Thus, when the thumb is put on the supporting portion 30, it is possible to prevent the thumb from slipping in the up-down direction with respect to the supporting face 30*a*; thus, it is possible to more stably extract the sheet feed cassette 10. It is also possible to further improve the visibility of the supporting face 30*a*.

As described above, the supporting face 30*a* is formed in a different color from the front face 20*a* of the manual feed tray 20. Thus, it is possible to further improve the visibility of the supporting face 30*a*.

As described above, the supporting face 30*a* is formed in the same color as the front face 12*a* of the sheet feed cassette 10. If the supporting face 30*a* is formed in the same color as the front face 12*a* of the sheet feed cassette 10, the visibility of the supporting face 30*a* is likely to diminish; thus, it is particularly effective to form the supporting face 30*a* in a different color from the front face 20*a* of the manual feed tray 20 when the supporting face 30*a* is formed in the same color as the front face 12*a* of the sheet feed cassette 10.

As described above, the supporting face 30*a* has a size of 20 mm or more in the up-down direction. Thus, it is possible to prevent the thumb from being put on the front face 20*a* of the manual feed tray 20.

As described above, the top end 22*a* of the cutout portion 22 is arranged, when the manual feed tray 20 is in the open state, above the center of the supporting face 30*a* in the up-down direction. Accordingly, even when the manual feed tray 20 is in the open state (the state where it is arranged in the second position), it is possible to prevent the supporting face 30*a* from becoming invisible from in front of the apparatus main body 3; thus, it is possible to easily put the thumb on the supporting face 30*a* when the sheet feed cassette 10 is extracted.

The embodiments disclosed herein should be understood to be in every respect illustrative and not restrictive. The scope of the present invention is not defined by the description of embodiments given above but by the appended claims, and encompasses any modifications made in the sense and scope equivalent to those of the claims.

For example, although the embodiments described above deal with an example where the present invention is applied to a printer, this is not meant to limit the present invention. Needless to say, the present invention is applicable to various image forming apparatuses, such as multifunction peripherals, copiers, and facsimile machines. Moreover, the present invention is applicable not only to an electrophotography type but also to thermal printers, inkjet printers, and the like.

Although the embodiments described above deal with an example where the swing shaft 21 of the manual feed tray 20 is arranged above the top end 30*b* of the supporting portion 30, this is not meant to limit the present invention. Instead, the swing shaft 21 of the manual feed tray 20 may be arranged below or at the same height as the top end 30*b* of the supporting portion 30.

Although the embodiments described above deal with an example where the supporting face 30*a* is arranged inside the apparatus main body 3 with respect to the front face 12*a* of the sheet feed cassette 10 and the front face 20*a* of the manual feed tray 20; instead, the supporting face 30*a* may be arranged to be flush with the front face 12*a* of the sheet feed cassette 10 and the front face 20*a* of the manual feed tray 20.

Although the embodiments described above deal with an example where surface irregularities are formed on the supporting face 30*a*; instead, the supporting face 30*a* may be formed flat.

Although the embodiments described above deal with an example where the supporting face 30*a* is formed in a different color from the front face 20*a* of the manual feed tray 20 but in the same color as the front face 12*a* of the sheet feed cassette 10, this is not meant to limit the present invention. For example, instead, the supporting face 30*a*, the front face 20*a* of the manual feed tray 20, and the front face 12*a* of the sheet feed cassette 10 may all be formed in the same color. Instead, the front face 20*a* of the manual feed tray 20 and the front face 12*a* of the sheet feed cassette 10 may be formed in the same color, and only the supporting face 30*a* may be formed in a different color. Instead, the supporting face 30*a* and the front face 20*a* of the manual feed tray 20 may be formed in the same color, and only the front face 12*a* of the sheet feed cassette 10 may be formed in a different color. Instead, the supporting face 30*a*, the front face 20*a* of the manual feed tray 20, and the front face 12*a* of the sheet feed cassette 10 may all be formed in different colors from each other.

The technical scope of the present invention covers any configuration obtained by appropriately combining different configurations of the embodiments and of the modified examples described above.

The invention claimed is:

1. An image forming apparatus comprising:

an apparatus main body;

a recording medium storing cassette provided to be extractable and insertable with respect to one side face of the apparatus main body; and a manual feed tray swingably arranged over the recording medium storing cassette, the manual feed tray being arranged selectively in a first position where the manual feed tray is housed in the one side face or in a second position where the manual feed tray is open at a predetermined angle with respect to the one side face; wherein the recording medium storing cassette has:

a first side face which, when the recording medium storing cassette is inserted in the apparatus main body, constitutes part of an exterior surface of the image forming apparatus; and a handle part which is provided in the first side face and into which a finger is insertable from below upward, the manual feed tray has a second side face which, when the manual feed tray is arranged in the first position, constitutes part of the exterior surface and is arranged continuous with the first side face, in a part over the handle part, between the first side face and the second side face, a supporting portion which is provided in the apparatus main body and which has a supporting face constituting part of the exterior surface is arranged, and on the supporting face, surface irregularities are formed which have a plurality of convex parts and a plurality of concave parts alternately arranged along at least an up-down direction.

2. The image forming apparatus according to claim 1, wherein a swing shaft of the manual feed tray is arranged over a top end of the supporting portion.

3. The image forming apparatus according to claim 1, wherein the supporting face is arranged substantially perpendicular to an extracting direction of the recording medium storing cassette.

4. The image forming apparatus according to claim 1, wherein at least part of the supporting face is arranged inside the apparatus main body with respect to the first side face and the second side face.

5. The image forming apparatus according to claim 1, wherein the supporting face is formed in a different color from the second side face.

6. The image forming apparatus according to claim 5, wherein the supporting face is formed in a same color as the first side face.

7. The image forming apparatus according to claim 1, wherein the supporting face has a size of 20 mm or more in an up-down direction.

8. The image forming apparatus according to claim 1, wherein in a lower end part of the second side face of the manual feed tray, a cutout portion surrounding part of an outer circumferential edge of the supporting portion is formed, and a top end of the cutout portion is arranged, when the manual feed tray is arranged in the second position, above a center of the supporting face in an up-down direction.

9. An image forming apparatus comprising:

an apparatus main body;

a recording medium storing cassette provided to be extractable and insertable with respect to one side face of the apparatus main body; and a manual feed tray swingably arranged over the recording medium storing cassette, the manual feed tray being arranged selectively in a first position where the manual feed tray is housed in the one side face or in a second position where the manual feed tray is open at a predetermined angle with respect to the one side face; wherein the recording medium storing cassette has:

a first side face which, when the recording medium storing cassette is inserted in the apparatus main body, constitutes part of an exterior surface of the image forming apparatus; and a handle part which is provided in the first side face and into which a finger is insertable from below upward, the manual feed tray has a second side face which, when the manual feed tray is arranged in the first position, constitutes part of the exterior surface and is arranged continuous with the first side face, in a part over the handle part, between the first side face and the second side face, a supporting portion which is provided in the apparatus main body and which has a supporting face constituting part of the exterior surface is arranged, in a lower end part of the second side face of the manual feed tray, a cutout portion surrounding part of an outer circumferential edge of the supporting portion is formed, and a top end of the cutout portion is arranged, when the manual feed tray is arranged in the second position, above a center of the supporting face in an up-down direction.

* * * * *